US010557102B2

(12) United States Patent
Doyen

(10) Patent No.: US 10,557,102 B2
(45) Date of Patent: Feb. 11, 2020

(54) LUBRICANT FOR MARINE ENGINES

(71) Applicant: TOTAL MARKETING SERVICES, Puteaux (FR)

(72) Inventor: Valérie Doyen, Four (FR)

(73) Assignee: TOTAL MARKETING SERVICES, Puteaux (FR)

( * ) Notice: Subject to any disclaimer, the term of this patent is extended or adjusted under 35 U.S.C. 154(b) by 0 days.

(21) Appl. No.: 15/522,691

(22) PCT Filed: Oct. 22, 2015

(86) PCT No.: PCT/EP2015/074485
§ 371 (c)(1),
(2) Date: Apr. 27, 2017

(87) PCT Pub. No.: WO2016/066517
PCT Pub. Date: May 6, 2016

(65) Prior Publication Data

US 2017/0313955 A1 Nov. 2, 2017

(30) Foreign Application Priority Data

Oct. 27, 2014 (FR) ..... 14 60292

(51) Int. Cl.
*C10M 133/06* (2006.01)

(52) U.S. Cl.
CPC .. *C10M 133/06* (2013.01); *C10M 2203/1006* (2013.01); *C10M 2203/1085* (2013.01); *C10M 2215/04* (2013.01); *C10N 2220/025* (2013.01); *C10N 2220/026* (2013.01); *C10N 2230/02* (2013.01); *C10N 2230/04* (2013.01); *C10N 2230/52* (2013.01); *C10N 2240/102* (2013.01)

(58) Field of Classification Search
CPC ..... C10M 133/06; C10M 2203/1006; C10M 2203/1085; C10M 2215/04; C10N 2220/025; C10N 2220/026; C10N 2230/02; C10N 2230/04; C10N 2230/52; C10N 2240/102
See application file for complete search history.

(56) References Cited

U.S. PATENT DOCUMENTS 3,814,212 A * 6/1974 Latos ..... C10M 1/08 184/109
2008/0026967 A1* 1/2008 Suda ..... C10M 101/00 508/459
2008/0053868 A1 3/2008 Kleijwegt et al.
2011/0030648 A1* 2/2011 Cook ..... C10M 129/38 123/196 M
2011/0092403 A1* 4/2011 Lancon ..... C10M 163/00 508/391

FOREIGN PATENT DOCUMENTS

WO 2009/153453 A2 12/2009

OTHER PUBLICATIONS

Jan. 7, 2016 Written Opinion issued in International Patent Application No. PCT/EP2015/074485.
Jan. 7, 2016 International Search Report issued in International Patent Application No. PCT/EP2015/074485.

* cited by examiner

*Primary Examiner* — James C Goloboy
(74) *Attorney, Agent, or Firm* — Oliff PLC

(57) ABSTRACT

A lubricant composition for engines has at least one base oil and one fatty amine.

13 Claims, No Drawings

LUBRICANT FOR MARINE ENGINES

The present invention is applicable to the field of lubricants, and more particularly to the field of lubricants for marine engines, especially for two-stroke marine engines. More particularly, the present invention relates to a lubricant for marine engines, comprising at least one base oil and at least one fatty amine.

The lubricant according to the invention has a high basicity reserve which is reflected by a high BN (Base Number) and may be used both with fuel oils with a high sulfur content and fuel oils with a low sulfur content. The lubricant according to the invention has a sufficient neutralizing power with respect to the sulfuric acid formed during the combustion of fuel oils with a high sulfur content and also a reduced or even nonexistent risk of increase of its viscosity, while at the same time limiting the formation of deposits at high temperature.

The lubricant according to the invention may also be characterized by a low BN value and may thus be used with fuel oils with a very low sulfur content, while at the same time having a reduced or even non-existent risk of increase of its viscosity and while limiting the formation of deposits at high temperature.

The present invention also relates to a process for lubricating a marine engine, and more particularly a two-stroke marine engine, using this lubricant.

The present invention also relates to a process for reducing the formation of deposits in the hot parts of a marine engine, especially of a two-stroke marine engine, comprising the placing in contact of said hot parts with a lubricant comprising a fatty amine.

The marine oils used in slow-speed two-stroke crosshead engines are of two types: cylinder oils, on the one hand, which lubricate the piston-cylinder assembly, and system oils, on the other hand, which lubricate all the moving parts other than those of the piston-cylinder assembly. Within the piston-cylinder assembly, combustion residues containing acidic gases are in contact with the lubricant oil.

Acidic gases form during the combustion of fuel oils; these are especially sulfur oxides ($SO_2$, $SO_3$), which are then hydrolyzed during contact with the moisture present in the combustion gases and/or in the oil. This hydrolysis generates sulfurous acid ($HSO_3$) or sulfuric acid ($H_2SO_4$).

To preserve the surface of the liners and to prevent excessive corrosive wear, these acids must be neutralized, which is generally performed by reaction with basic sites included in the lubricant.

The neutralizing capacity of an oil is measured by its BN, characterizing its basicity. It is measured according to standard ASTM D-2896 and is expressed in weight equivalent of potassium hydroxide per gram of oil or mg of KOH/g of oil. The BN is a standard criterion for adjusting the basicity of cylinder oils to the sulfur content of the fuel oil used, so as to be able to neutralize the sulfur contained in the fuel, which is liable to be transformed into sulfuric acid by combustion and hydrolysis.

Thus, the higher the sulfur content of a fuel oil, the higher must be the BN of a marine oil. This is why marine oils with a BN ranging from 5 to 100 mg KOH/g of oil are available on the market. This basicity is provided by detergents which are overbased with insoluble metal salts, especially metal carbonates. The usual overbased detergents intrinsically have a BN conventionally between 150 and 700 mg of potassium hydroxide per gram of detergent. Their mass content in the lubricant is determined as a function of the BN level to be reached.

Part of the BN may also be provided by detergents that are not overbased, or "neutral", with a BN typically less than 150 mg of potassium hydroxide per gram of detergent. However, it is not envisageable to produce marine engine cylinder lubricant formulations with a high BN, especially for two-stroke marine engines, in which all the BN is provided by "neutral" detergents: they would in point of fact need to be incorporated in excessive amounts, which might affect the efficiency of the lubricant and would not be realistic from an economic viewpoint.

The insoluble metal salts of overbased detergents, for example calcium carbonate, thus contribute significantly toward the BN of standard lubricants.

The detergent part per se, or soaps, which are found in both neutral and overbased detergents, typically provide the greater part of the remaining BN.

Environmental concerns have entailed in certain areas, and especially in coastal areas, requirements in terms of limitation of the sulfur content in the fuel oils used in marine vessels.

Thus, the MARPOL Annexe 6 regulation (Regulations for the Prevention of air pollution from ships) of the IMO (International Maritime Organization) came into force in May 2005. It sets a maximum sulfur content of 4.5% by weight relative to the total weight of the fuel oil for heavy fuel oils and also the creation of areas of controlled emission of sulfur oxides, known as SECAs (SOx Emission Control Areas). The term "heavy fuel oils" means high-viscosity fuels mainly used by large diesel engines installed in marine vessels.

Thus, the marine vessels entering these areas must use fuel oils with a maximum sulfur content of 1.5% by weight relative to the total weight of the fuel oil or any other alternative treatment directed toward limiting the SOx emissions to comply with the specified values.

More recently, amendments to the MARPOL Annexe 6 regulation have been made. These amendments are summarized in the table below. Thus, the maximum sulfur content restrictions have become tighter, with a limited worldwide maximum content from 4.5% by weight relative to the total weight of the fuel oil to 3.5% by weight relative to the total weight of the fuel oil. The SECAs (Sulfur Emission Control Areas) have become ECAs (Emission Control Areas) with a complementary lowering of the maximum admissible sulfur content from 1.5% by weight relative to the total weight of the fuel oil to 1.0% by weight relative to the total weight of the fuel oil and the addition of new limits concerning the NOx and particles contents.

| | Amendments to MARPOL Annexe 6 (MEPC meeting No. 57-April 2008) | |
|---|---|---|
| Maximum sulfur content | General limit<br>3.5% by weight relative to the total weight of the fuel oil on Jan. 1, 2012<br>0.5% by weight relative to the total weight of the fuel oil on Jan. 1, 2020 | Limit for the ECAs<br>1% by weight relative to the total weight of the fuel oil on Jan. 7, 2010<br>0.1% by weight relative to the total weight of the fuel oil on Jan. 1, 2015 |

Marine vessels following transcontinental routes use several types of heavy fuel oil as a function of the local environmental constraints, while at the same time allowing them to optimize their operating cost.

Thus, many container ships use several bunkers, for a fuel oil with a high sulfur content (not more than 3.5% by weight of sulfur relative to the total weight of the fuel oil and higher) or "high sea" fuel oil, on the one hand, and for an 'ECA' fuel oil with a sulfur content of less than or equal to 1% by weight relative to the total weight of the fuel oil, on the other hand.

Switching between these two categories of fuel oil may require the adaptation of the operating conditions of the engine, in particular the use of suitable cylinder lubricants. At the present time, in the presence of fuel oil with a high sulfur content (3% by weight relative to the total weight of the fuel oil and higher), marine lubricants with a BN of the order of 70 mg of KOH/mg of lubricant are mainly used.

In the presence of a fuel oil with a low sulfur content (1% by weight relative to the total weight of the fuel oil and lower), marine lubricants with a BN of the order of 40 mg of KOH/mg of lubricant may mainly be recommended.

In these two cases, a sufficient neutralizing capacity is then reached since the necessary concentration of basic sites provided by the overbased detergents of the marine lubricant is reached, but it is necessary to change the lubricant at each change of type of fuel oil.

Furthermore, each of these lubricants has operating limits for the following reasons: the use of a cylinder lubricant of BN 70 mg of KOH/g of lubricant in the presence of a fuel oil with a low sulfur content (1% by weight relative to the total weight of the fuel oil and lower) and for a fixed lubrication rate, creates a large excess of basic sites and a risk of destabilization of the unused overbased detergent micelles, which contain insoluble metal salts. This destabilization may result in the formation of insoluble metal salt deposits (for example calcium carbonate) of high hardness, mainly on the piston crown, and in the long term may lead to a risk of excessive wear such as liner polishing. As regards the use of a cylinder lubricant with a BN of 40 mg of KOH/g of lubricant, such a BN does not provide sufficient neutralizing capacity to the lubricant in the presence of a fuel with a high sulfur content and may thus lead to a high risk of corrosion.

Thus, optimization of the cylinder lubrication of a two-stroke engine then requires the selection of a lubricant whose BN is adapted to the sulfur content of the fuel oil used and to the operating conditions of the engine. This optimization reduces the operating flexibility of the engine and demands high technical proficiency of the crew in the definition of the conditions under which the changing from one type of lubricant to another must be made.

Patent application WO2009/153453 describes the use of fatty amines in a two-stroke engine marine lubricant which may be used with fuel oils with high and low sulfur contents.

However, the BN of the lubricant described in said document is limited and does not exceed 72.

U.S. Pat. No. 3,814,212 relates to a lubricant composition comprising a polyamine containing at least 12 carbon atoms. The lubricant composition may also comprise other additives such as a mineral oil.

However, the lubricant composition described in said document is not a lubricant composition for marine engines. Furthermore, this composition does not comprise any neutral and/or overbased detergents.

Moreover, depending on the nature of the amine, a risk of formation of deposits at high temperature may appear, thus impairing the efficiency of the lubricant and the cleanliness of the engine.

Specifically, the operating temperature of marine engines, and especially of two-stroke marine engines, is incessantly increasing. Thus, the lubricant, which is in direct contact with the engine, and especially with the hot parts of the engine such as the ring/piston/liner (or RPL) area, must have increased heat resistance and thus minimize or even prevent the formation of deposits in these hot parts.

Moreover, there is at the present time demand for low-BN marine lubricants, especially with a BN of less than or equal to 40, which are intended to be used in the presence of fuel oils with a very low sulfur content (sulfur content less than 0.5%) and having increased heat resistance.

Thus, it would be desirable to have available a marine lubricant, especially for two-stroke marine engines, which can have a high BN, especially close or equal to 100, or a low BN, especially close or equal to 25, while at the same time having increased heat resistance and thus little risk of formation of deposits in the hot parts of the engine.

It would also be desirable to have available a lubricant for marine engines, especially for two-stroke marine engines, which has very little or no risk of increasing in viscosity over time, and especially in the course of its use.

DESCRIPTION OF THE INVENTION

One object of the present invention is to provide a lubricant composition that overcomes some or all of the abovementioned drawbacks.

Another objective of the present invention is to provide an age-resistant lubricant composition which conserves its properties over time.

Another objective of the invention is to provide a lubricant composition whose formulation is easy to use.

Another objective of the invention is to provide a lubricant composition which can minimize or even prevent the formation of deposits in the hot parts of a marine engine.

Another objective of the present invention is to provide a process for lubricating a marine engine, and more particularly a two-stroke marine engine, which can be used both with fuel oils with a high sulfur content and fuel oils with a low sulfur content.

Another object of the present invention is to provide a process for lubricating a marine engine, and more particularly a two-stroke marine engine, which may be used with fuel oils with a very low sulfur content.

Another objective of the present invention is to provide a process for reducing the formation of deposits in the hot parts of a marine engine, and more particularly of a two-stroke marine engine.

The present invention thus relates to a lubricant composition comprising:

at least one lubricant base oil, at least one fatty amine of formula (I):

$$R_1R_2N—(CH_2)_3—[NH(CH_2)_3]_n—NH_2 \quad (I)$$

in which:

$R_1$ represents a saturated, linear or branched alkyl group comprising at least 14 carbon atoms, $R_2$ represents a saturated, linear or branched alkyl group comprising at least 14 carbon atoms, n represents 0, 1 or 2, the fatty amine having a BN determined according to standard ASTM D-2896 ranging from 150 to 350 milligrams of potassium hydroxide per gram of amine.

Preferably, the present invention relates to a marine engine lubricant composition comprising:

at least one lubricant base oil, at least one fatty amine of formula (I).

$$R_1R_2N—(CH_2)_3—[NH(CH_2)_3]_n—NH_2 \quad (I)$$

in which:

$R_1$ represents a saturated, linear or branched alkyl group comprising at least 14 carbon atoms, $R_2$ represents a saturated, linear or branched alkyl group comprising at least 14 carbon atoms, n represents 0, 1 or 2, the fatty amine having a BN determined according to standard ASTM D-2896 ranging from 150 to 350 milligrams of potassium hydroxide per gram of amine, at least one additive chosen from overbased detergents and/or neutral detergents.

The Applicant has observed that it is possible to formulate lubricant compositions, especially for marine engines, in which a significant part of the BN is provided by fatty amines that are soluble in the lubricant base oil, while at the same time maintaining the same performance level relative to standard formulations of equivalent or even higher BN.

The performance qualities under consideration herein are in particular the reduction of the formation of deposits, measured by means of the ECBT test described below, and also the high-temperature heat resistance, measured by means of the TGA and DSC tests, also described below.

The lubricant composition according to the invention thus has such performance qualities, while at the same time conserving viscosity which makes it suitable for its use.

Thus, the present invention makes it possible to formulate lubricant compositions with a high BN for marine engines, especially for two-stroke marine engines, which may be used both with fuel oils with a high sulfur content and fuel oils with a low sulfur content and which afford a reduced risk of formation of deposits while at the same time maintaining the other performance qualities of the lubricant composition.

Advantageously, the present invention also makes it possible to formulate lubricant compositions with a low BN for marine engines, especially for two-stroke marine engines, which may be used with fuel oils with a very low sulfur content and which afford a reduced risk of formation of deposits while at the same time maintaining the other performance qualities of the lubricant composition.

Advantageously, the lubricant compositions according to the invention have a good capacity for neutralizing sulfuric acid.

Advantageously, the lubricant compositions according to the invention have increased heat resistance, especially at high temperature.

Advantageously, the lubricant compositions according to the invention conserve good stability of the viscosity over time.

Advantageously, the lubricant compositions according to the invention have very little or no risk of thickening as a function of the working conditions.

In another embodiment, the lubricant composition consists essentially of:

at least one lubricant base oil, at least one fatty amine of formula (I):

$$R_1R_2N—(CH_2)_3—[NH(CH_2)_3]_n—NH_2 \quad (I)$$

in which:

$R_1$ represents a saturated, linear or branched alkyl group comprising at least 14 carbon atoms, $R_2$ represents a saturated, linear or branched alkyl group comprising at least 14 carbon atoms, n represents 0, 1 or 2, the fatty amine having a BN determined according to standard ASTM D-2896 ranging from 150 to 350 milligrams of potassium hydroxide per gram of amine.

The invention also relates to the use of a lubricant composition as defined above for lubricating a marine engine, especially a two-stroke marine engine.

The invention also relates to the use of a lubricant composition as defined above as a one-cylinder lubricant which may be used both with fuel oils with a sulfur content less than 1% by weight relative to the total weight of the fuel oil and with fuel oils with a sulfur content ranging from 1 to 3.5% by weight relative to the total weight of the fuel oil, and also with fuel oils with a sulfur content of greater than 3.5% by weight relative to the total weight of the fuel oil.

In one embodiment, the lubricant composition as defined above is used as a one-cylinder lubricant that may be used both with fuel oils with a sulfur content of less than 1% by weight relative to the total weight of the fuel oil and with fuel oils with a sulfur content ranging from 1 to 3.5% by weight relative to the total weight of the fuel oil.

The invention also relates to the use of a lubricant composition as defined above as a cylinder lubricant which may be used with fuel oils with a sulfur content of less than 0.5% by weight relative to the total weight of the fuel oil.

The invention also relates to the use of a lubricant composition as defined above for reducing the formation of deposits in the hot parts of a marine engine, preferentially in the ring-pistons-liner (RPL) area.

The invention also relates to a process for lubricating a marine engine, especially a two-stroke marine engine, comprising at least one step of placing the engine in contact with a lubricant composition as defined above.

The invention also relates to a process for reducing the formation of deposits in the hot parts of a marine engine, especially of a two-stroke marine engine, comprising at least one step of placing said hot parts of the engine in contact with a lubricant composition as defined above.

The invention also relates to the use of a fatty amine in a lubricant composition for reducing the formation of deposits in the hot parts of a marine engine, the fatty amine being a fatty amine of formula (I):

$$R_1R_2N—(CH_2)_3—[NH(CH_2)_3]_n—NH_2 \quad (I)$$

in which:

$R_1$ represents a saturated, linear or branched alkyl group comprising at least 14 carbon atoms, $R_2$ represents a saturated, linear or branched alkyl group comprising at least 14 carbon atoms, n represents 0, 1 or 2, the fatty amine of formula (I) having a BN determined according to standard ASTM D-2896 ranging from 150 to 350 milligrams of potassium hydroxide per gram of amine.

DETAILED DESCRIPTION OF THE INVENTION

The percentages indicated below correspond to mass percentages of active material.

Fatty Amines.

The lubricant composition according to the invention comprises at least one fatty amine of formula (I):

$$R_1R_2N—(CH_2)_3—[NH(CH_2)_3]_n—NH_2 \quad (I)$$

in which:

$R_1$ represents a saturated, linear or branched alkyl group comprising at least 14 carbon atoms, $R_2$ represents a saturated, linear or branched alkyl group comprising at least 14 carbon atoms, n represents 0, 1 or 2 or 3, the fatty amine having a BN determined according to standard ASTM D-12896 ranging from 150 to 350 milligrams of potassium hydroxide per gram of amine.

$R_1$ and $R_2$, which may be identical or different, independently represent a saturated, linear or branched alkyl group, comprising at least 14 carbon atoms; which means that the fatty amine according to the invention does not comprise any unsaturations. Thus, the degree of unsaturation in the fatty amine according to the invention is zero. The fatty amines are obtained from saturated carboxylic acids.

The starting fatty acids that are preferred for obtaining fatty amines according to the invention may be derived from the hydrolysis of triglycerides present in plant and animal oils, such as coconut oil, palm oil, olive oil, groundnut oil, rapeseed oil, sunflower oil, soya oil, cottonseed oil, linseed oil, beef tallow, etc.

The natural oils may have been genetically modified so as to enrich their content in certain fatty acids. Examples that may be mentioned include rapeseed oil or oleic sunflower oil.

In one embodiment, the fatty amines used in the lubricants according to the invention may be obtained from natural plant or animal resources.

In one embodiment of the invention, the fatty amine may be a fatty amine of formula (I) in which:

$R_1$ represents a saturated, linear or branched alkyl group comprising from 14 to 22 carbon atoms, preferably from 14 to 18 carbon atoms, advantageously from 16 to 18 carbon atoms, $R_2$ represents a saturated, linear or branched alkyl group comprising from 14 to 22 carbon atoms, preferably from 14 to 18 carbon atoms, advantageously from 16 to 18 carbon atoms.

In another embodiment of the invention, the fatty amine may be a fatty amine of formula (I) in which $R_1$ and $R_2$, which are identical, represent a saturated, linear or branched alkyl group comprising from 14 to 22 carbon atoms, preferably from 14 to 18 carbon atoms, advantageously from 16 to 18 carbon atoms.

In a preferred embodiment of the invention, the fatty amine is a fatty amine of formula (Ia):

$$(R_1)_2N—(CH_2)_3—NH_2 \quad \text{(Ia)}$$

in which $R_1$ represents a saturated, linear or branched alkyl group comprising from 14 to 18 carbon atoms, preferably from 16 to 18 carbon atoms.

In another preferred embodiment of the invention, the fatty amine is a fatty amine of formula (Ib):

$$(R_1)_2N—(CH_2)_3—[NH(CH_2)_3]_n—NH_2 \quad \text{(Ib)}$$

in which:

$R_1$ represents a saturated, linear or branched alkyl group comprising from 14 to 18 carbon atoms, preferably from 16 to 18 carbon atoms, and n represents 1 or 2.

In a more preferred embodiment of the invention, the fatty amine of formula (I) is a fatty amine of formula (Ib-1):

$$(R_1)_2N—(CH_2)_3—NH(CH_2)_3—NH_2 \quad \text{(Ib-1)}$$

in which $R_1$ represents a saturated, linear or branched alkyl group comprising from 14 to 18 carbon atoms, preferably from 16 to 18 carbon atoms.

In another more preferred embodiment of the invention, the fatty amine of formula (I) is a fatty amine of formula (Ib-2):

$$(R_1)_2N—(CH_2)_3—[NH(CH_2)_3]_2—NH_2 \quad \text{(Ib-2)}$$

in which $R_1$ represents a saturated, linear or branched alkyl group comprising from 14 to 18 carbon atoms, preferably from 16 to 18 carbon atoms.

In one embodiment of the invention, the BN of the fatty amine determined according to standard ASTM ID-2896 ranges from 170 to 340 milligrams of potassium hydroxide per gram of amine, preferably from 180 to 320 milligrams of potassium hydroxide per gram of amine.

In another embodiment of the invention, the lubricant composition according to the invention does not comprise any fatty amines other than the fatty amine of formula (I). Thus, in this embodiment, the lubricant composition according to the invention comprises only one fatty amine corresponding to a fatty amine of formula (I).

In another embodiment of the invention, the lubricant composition has a BN determined according to standard ASTM D-2896 of at least 70, preferentially of at least 80, more preferentially of at least 90, advantageously of at least 95 milligrams of potassium hydroxide per gram of lubricant composition.

In another embodiment of the invention, the lubricant composition has a BN determined according to standard ASTM D-2896 ranging from 70 to 120, preferentially from 70 to 100, more preferentially from 80 to 100, advantageously from 90 to 100 milligrams of potassium hydroxide per gram of lubricant composition.

In a preferred embodiment of the invention, the lubricant composition has a BN determined according to standard ASTM D-2896 equal to 100 milligrams of potassium hydroxide per gram of lubricant composition.

In another embodiment of the invention, the mass percentage of fatty amine relative to the total weight of the lubricant composition is chosen so that the BN provided by this compound represents a contribution of from 5 to 60 milligrams of potassium hydroxide per gram of lubricant, more preferentially from 10 to 30 milligrams of potassium hydroxide per gram of lubricant to the total BN of said lubricant composition.

In a preferred embodiment of the invention, the mass percentage of fatty amine relative to the total weight of the lubricant composition ranges from 2 to 10%, preferably from 3 to 10%, advantageously from 4 to 9%.

In another embodiment of the invention, the lubricant composition has a BN determined according to standard ASTM D-2896 of not more than 50, preferably not more than 40, advantageously not more than 30 milligrams of potassium hydroxide per gram of lubricant composition.

In another embodiment of the invention, the lubricant composition has a BN determined according to standard ASTM D-2896 ranging from 10 to 30, preferably from 15 to 30, advantageously of 15 to 25 milligrams of potassium hydroxide per gram of lubricant composition.

In a preferred embodiment of the invention, the lubricant composition has a BN determined according to standard ASTM D-2896 equal to 25 milligrams of potassium hydroxide per gram of lubricant composition.

In a preferred embodiment of the invention, the mass percentage of fatty amine relative to the total weight of the lubricant composition ranges from 0.1 to 15%, preferably from 0.5 to 10%, advantageously from 3 to 10%.

In a preferred embodiment of the invention, the mass percentage of fatty amine relative to the total weight of the lubricant composition also ranges from 0.1 to 15%, preferably from 0.5 to 10%, advantageously from 0.5 to 9%, more advantageously from 0.5 to 8%.

Lubricant Base Oils

The lubricant composition according to the invention comprises at least one lubricant base oil.

In general, the lubricant base oils used for the formulation of lubricant compositions according to the present invention may be oils of mineral, synthetic or plant origin and also mixtures thereof.

The mineral or synthetic oils generally used in the application belong to one of the groups I to V according to the classes defined in the API classification (or equivalents thereof such as the ATIEL classification) as summarized below. In addition, the lubricant base oil(s) used in the cylinder lubricants according to the invention may be chosen from oils of synthetic origin from group VI according to the ATIEL classification. The API classification is defined in American Petroleum Institute 1509 "Engine oil Licensing and Certification System" 17th edition, September 2012.

The ATIEL classification is defined in "The ATIEL Code of Practice", number 18, November 2012.

| | Content of saturates | Sulfur content | Viscosity index |
|---|---|---|---|
| Group I Mineral oils | <90% | >0.03% | 80 ≤ VI < 120 |
| Group II Hydrocracked oils | ≥90% | ≤0.03% | 80 ≤ VI < 120 |
| Group III Hydrocracked or hydroisomerized oils | ≥90% | ≤0.03% | ≥120 |
| Group IV | PAO (Poly-alpha-olefins) | | |
| Group V | Esters and other bases not included in bases from groups I to IV | | |
| Group VI* | Internal polyolefins (or Poly Internal Olefins, PIO) | | |

*for the ATIEL classification only

The mineral oils of Group I may be obtained by distillation of selected naphthenic or paraffinic crude oils followed by purification of these distillates via processes such as solvent extraction, solvent dewaxing, catalytic dewaxing, hydrotreatment or hydrogenation.

The oils of Groups II and III are obtained via more stringent purification processes, for example a combination among hydrotreatment, hydrocracking, hydrogenation and catalytic dewaxing.

The examples of synthetic bases of Groups IV and V include polyisobutenes, alkylbenzenes and poly-alpha-olefins such as polybutenes.

These lubricant base oils may be used alone or as a mixture. A mineral oil may be combined with a synthetic oil.

Cylinder oils for two-stroke marine engines have a viscometric grade SAE-40 to SAE-60, generally SAE-50 equivalent to a kinematic viscosity at 100° C. of between 16.3 and 21.9 $mm^2/s$ measured according to standard ASTM D445.

Oils of SAE-40 grade have a kinematic viscosity at 100° C. of between 12.5 and 16.3 cSt measured according to standard ASTM D445.

Oils of SAE-50 grade have a kinematic viscosity at 100° C. of between 16.3 and 21.9 cSt measured according to standard ASTM D445.

Oils of SAE-60 grade have a kinematic viscosity at 100° C. of between 21.9 and 26.1 cSt measured according to standard ASTM D445.

In a preferred embodiment of the invention, the lubricant compositions according to the invention have a kinematic viscosity measured according to standard ASTM D445 at 100° C. ranging from 12.5 to 26.1 cSt, preferentially from 16.3 to 21.9 cSt.

This viscosity may be obtained by mixing additives and base oils containing, for example, mineral bases of Group I such as neutral solvent bases (for example 500 NS or 600 NS) and Brightstock. Any other combination of mineral bases, synthetic bases or bases of plant origin having, as a mixture with the additives, a viscosity that is compatible with the SAE-50 grade may be used.

Typically, a conventional formulation of a lubricant composition for two-stroke marine engines is of SAE-40 to SAE-60 grade, preferentially SAE-50 (according to the classification SAE J300) and comprises at least 40% by weight of lubricant base oil of mineral or synthetic origin or mixtures thereof, which is suitable for use for a marine engine. For example, a lubricant base oil of group I according to the API classification, i.e. obtained via the following operations: distillation of selected crude oils followed by purification of these distillates via processes such as solvent extraction, solvent dewaxing, catalytic dewaxing, hydrotreatment or hydrogenation, may be used for the formulation of a cylinder lubricant. The lubricant base oils of group I have a viscosity index (VI) ranging from 80 to 120; their sulfur content is greater than 0.03% and their content of saturated hydrocarbon-based compounds is less than 90%.

Other Additives

The lubricant composition may also comprise at least one additive chosen from overbased detergents and/or neutral detergents.

The lubricant composition may also comprise an additive chosen from overbased detergents or neutral detergents.

The overbased detergents or neutral detergents used in the lubricant compositions according to the present invention are well known to those skilled in the art.

The detergents commonly used in the formulation of lubricants are typically anionic compounds comprising a long lipophilic hydrocarbon-based chain and a hydrophilic head. The associated cation is typically a metal cation of an alkali metal or an alkaline-earth metal.

The detergents are preferentially chosen from the alkali metal or alkaline-earth metal salts of carboxylic acids, sulfonates, salicylates, naphthenates and also phenate salts. The alkali metals and alkaline-earth metals are preferentially calcium, magnesium, sodium or barium.

These metal salts may contain the metal in an approximately stoichiometric amount relative to the anionic group(s) of the detergent. In this case, they are referred to as non-overbased or "neutral" detergents, even though they also provide a certain level of basicity. These "neutral" detergents typically have a BN measured according to ASTM D2896 of less than 150 mg KOH/g, or less than 100 mg KOH/g, or even less than 80 mg KOH/g of detergent.

"Neutral" detergents of this type may contribute partially to the BN of the lubricant compositions according to the present invention. Neutral detergents of the type such as alkali metal and alkaline-earth metal, for example calcium, sodium, magnesium or barium, carboxylates, sulfonates, salicylates, phenates or naphthenates will be used, for example.

When the metal is in excess (in an amount greater than the stoichiometric amount relative to the anionic group(s) of the detergent), the detergents under consideration are said to be "overbased". Their BN is high, greater than 150 mg KOH/g of detergent, typically ranging from 200 to 700 mg KOH/g of detergent, preferentially from 250 to 450 mg KOH/g of detergent.

The metal in excess providing the overbased nature to the detergent is present in the form of metal salts that are insoluble in the oil, for example carbonate, hydroxide, oxalate, acetate, glutamate, preferentially carbonate.

In the same overbased detergent, the metals of these insoluble salts may be the same as those of the detergents that are soluble in the oil or may be different. They are preferentially chosen from calcium, magnesium, sodium or barium.

The overbased detergents are thus in the form of micelles composed of insoluble metal salts maintained in suspension in the lubricant composition by the detergents in the form of metal salts that are soluble in the oil.

These micelles may contain one or more types of insoluble metal salts, stabilized with one or more detergent types.

The overbased detergents comprising only one type of detergent soluble metal salt will generally be referred to according to the nature of the hydrophobic chain of the latter detergent.

Thus, they will be said to be of phenate, salicylate, sulfonate or naphthenate type depending on whether this detergent is, respectively, a phenate, salicylate, sulfonate or naphthenate.

The overbased detergents will be said to be of mixed type if the micelles comprise several types of detergents, which differ from each other in the nature of their hydrophobic chain.

In one embodiment of the invention, the overbased detergent and the neutral detergent may be chosen from carboxylates, sulfonates, salicylates, naphthenates, phenates, and the mixed detergents combining at least two of these types of detergents.

In a preferred embodiment of the invention, the overbased detergent and the neutral detergent are compounds based on metals chosen from calcium, magnesium, sodium or barium, preferentially calcium or magnesium.

In another preferred embodiment of the invention, the overbased detergent is overbased with insoluble metal salts chosen from the group of alkali metal and alkaline-earth metal carbonates, preferentially calcium carbonate.

In another preferred embodiment of the invention, the lubricant composition comprises at least one overbased detergent and at least one neutral detergent as defined above.

In another preferred embodiment of the invention, the lubricant composition comprises at least 3% by weight of overbased detergent and/or of neutral detergent relative to the total weight of the composition.

As as function of the desired BN of the lubricant composition, a person skilled in the art will be capable, by means of his general knowledge, of determining the content of overbased detergent and/or neutral detergent to be added to the lubricant composition according to the invention.

As mentioned above, in one embodiment of the invention, the lubricant composition has a BN determined according to standard ASTM D-2896 of not more than 50, preferably not more than 40, advantageously not more than 30 milligrams of potassium hydroxide per gram of lubricant composition, especially ranging from 10 to 30, preferably from 15 to 30, advantageously from 15 to 25 milligrams of potassium hydroxide per gram of lubricant composition.

In this embodiment of the invention, it is possible for the lubricant composition not to comprise detergents based on alkali metals or alkaline-earth metals overbased with carbonate metal salts.

The lubricant composition according to the invention may also comprise an additional compound chosen from:

primary, secondary or tertiary fatty monoalcohols, the alkyl chain of which is saturated or unsaturated, linear or branched and comprising at least 12 carbon atoms, preferentially from 12 to 24 carbon atoms, more preferentially from 16 to 18 carbon atoms, advantageously primary monoalcohols bearing a saturated linear alkyl chain, esters of saturated fatty monoacids comprising at least 14 carbon atoms and of alcohols comprising not more than 6 carbon atoms, preferentially mono- and diesters, advantageously monoesters of monoalcohols and diesters of polyols in which the ester functions are separated by not more than four carbon atoms counting from the oxygen side of the ester function.

In one embodiment of the invention, the content of additional compound as defined above ranges from 0.01 to 10%, preferably from 0.1 to 2% by weight relative to the total weight of the lubricant composition.

The lubricant composition may also comprise at least one other additional additive chosen from dispersants, anti-wear additives or any other functional additive.

Dispersants are well-known additives used in the formulation of a lubricant composition, especially for application in the marine sector. Their primary role is to maintain in suspension the particles initially present or appearing in the lubricant in the course of its use in the engine. They prevent the agglomeration thereof by modifying the steric bulk. They may also have a synergistic effect on the neutralization.

The dispersants used as lubricant additives typically contain a polar group, combined with a relatively long hydrocarbon-based chain, generally containing from 50 to 400 carbon atoms. The polar group typically contains at least one nitrogen, oxygen or phosphorus element.

Succinic acid-based compounds are dispersants that are particularly used as lubrication additives. Use is made in particular of succinimides, obtained by condensation of succinic anhydrides and amines, succinic esters obtained by condensation of succinic anhydrides and alcohols or polyols.

These compounds may then be treated with various compounds, especially sulfur, oxygen, formaldehyde, carboxylic acids and compounds containing boron or zinc to produce, for example, borate succinimides or zinc-blocked succinimides.

Mannich bases, obtained by polycondensation of phenols substituted with alkyl groups, formaldehyde and primary or secondary amines, are also compounds used as dispersants in lubricants.

In one embodiment of the invention, the content of dispersant may be greater than or equal to 0.1%, preferably from 0.5 to 2%, advantageously from 1 to 1.5% by weight relative to the total weight of the lubricant composition.

The anti-wear additives protect the friction surfaces by forming a protective film that is adsorbed onto these surfaces. The additive most commonly used is zinc dithiophosphate or DTPZn. Various phosphorus, sulfur, nitrogen, chlorine and boron compounds are also found in this category.

A wide variety of anti-wear additives exists, but the category most commonly used is that of phospho-sulfur additives such as metal alkylthiophosphates, in particular zinc alkylthiophosphates, and more specifically zinc dialkyldithiophosphates or DTPZn. The preferred compounds are of formula $Zn((SP(S)(OR_3)(OR_4))_2$, in which $R_3$ and $R_4$ are alkyl groups, preferentially comprising from 1 to 18 carbon atoms. DTPZn is typically present in contents of the order of 0.1 to 2% by weight relative to the total weight of the lubricant composition.

Amine phosphates and polysulfides, especially sulfur-based olefins, are also anti-wear additives that are commonly used.

Anti-wear and extreme-pressure additives of nitrogen and sulfur type are also usually encountered in lubricant compositions for marine engines, for instance metal dithiocarbamates, in particular molybdenum dithiocarbamate. Glycerol esters are also anti-wear additives. Mention may be made, for example, of mono-, di- and trioleates, monopalmitates and monomyristates.

In one embodiment, the content of anti-wear additives ranges from 0.01 to 6%, preferentially from 0.1 to 4% by weight relative to the total weight of the lubricant composition.

The other functional additives may be be chosen from thickeners, antifoam additives for countering the effect of the detergents, which may be, for example, polar polymers such as polymethylsiloxanes, polyacrylates, antioxidant and/or anti-rust additives, for example organometallic detergents or thiadiazoles. These additives are known to those skilled in the art. They are generally present in a weight content of from 0.1 to 5% relative to the total weight of the lubricant composition.

A subject of the invention is also a cylinder lubricant comprising a lubricant composition as described above.

All the characteristics and preferences presented for the lubricant composition also apply to the above cylinder lubricant.

A subject of the invention is also the use of a lubricant composition as defined above for lubricating a marine engine, especially a two-stroke marine engine.

All the characteristics and preferences presented for the lubricant composition also apply to the above use.

A subject of the invention is also the use of a lubricant composition as defined above as a one-cylinder lubricant which may be used both with fuels with a sulfur content of less than 1% by weight relative to the total weight of the fuel, and with fuel oils with a sulfur content ranging from 1 to 3.5% by weight relative to the total weight of the fuel oil, and also with fuel oils with a sulfur content of greater than 3.5% by weight relative to the total weight of the fuel oil.

In one embodiment, a subject of the invention is the use of a lubricant composition as defined above as a one-cylinder lubricant which may be used both with fuel oils with a sulfur content of less than 1% by weight relative to the total weight of the fuel oil and with fuel oils with a sulfur content ranging from 1 to 3.5% by weight relative to the total weight of the fuel oil.

All the characteristics and preferences presented for the cylinder lubricant composition also apply to the above use.

In a preferred embodiment of the invention, this use corresponds to the use of a lubricant composition with a BN determined according to standard ASTM D-2896 of at least 70, preferentially of at least 80, more preferentially of at least 90, advantageously of at least 95 milligrams of potassium hydroxide per gram of lubricant composition, especially ranging from 70 to 120, preferentially from 70 to 100, more preferentially from 80 to 100, advantageously from 90 to 100 milligrams of potassium hydroxide per gram of lubricant composition, and more particularly with a BN equal to 100 milligrams of potassium hydroxide per gram of lubricant composition.

A subject of the invention is also the use of a lubricant composition as defined above as a cylinder lubricant which may be used with fuel oils with a sulfur content of less than 0.5% by weight relative to the total weight of the fuel oil.

All the characteristics and preferences presented for the cylinder lubricant composition also apply to the above use.

In a preferred embodiment of the invention, this use corresponds to the use of a lubricant composition with a BN determined according to standard ASTM D-2896 of not more than 50, preferably not more than 40, advantageously not more than 30 milligrams of potassium hydroxide per gram of lubricant composition, especially ranging from 10 to 30, preferably from 15 to 30, advantageously from 15 to 25 milligrams of potassium hydroxide per gram of lubricant composition.

A subject of the invention is also the use of a lubricant composition as defined above for reducing the formation of deposits in the hot parts of a marine engine, especially of a two-stroke marine engine.

In a marine engine, especially in a two-stroke marine engine, certain parts are subjected to high temperatures that may be up to 300° C.

This preferentially concerns the ring-pistons-liner (RPL) area.

Thus, on coming into contact with these hot parts, the lubricant composition may be subjected to very high temperatures, whence the need to have increased heat resistance.

All the characteristics and preferences presented for the cylinder lubricant composition also apply to the above use.

A subject of the invention is also a process for lubricating a marine engine, especially a two-stroke marine engine, comprising at least one step of placing the engine in contact with a lubricant composition as defined above.

All the characteristics and preferences presented for the cylinder lubricant composition also apply to the above process.

A subject of the invention is also a process for reducing the formation of deposits in the hot parts of a marine engine, especially of a two-stroke marine engine, comprising at least one step of placing said hot parts of the engine in contact with a lubricant composition as defined above.

All the characteristics and preferences presented for the cylinder lubricant composition also apply to the above process.

The invention also relates to the use of a fatty amine in a lubricant composition for reducing the formation of deposits in the hot parts of a marine engine, the fatty amine being a fatty amine of formula (I):

$$R_1R_2N—(CH_2)_3—[NH(CH_2)_3]_n—NH_2 \quad (I)$$

in which:

$R_1$ represents a saturated, linear or branched alkyl group comprising at least 14 carbon atoms, $R_2$ represents a saturated, linear or branched alkyl group comprising at least 14 carbon atoms, n represents 0, 1 or 2, the fatty amine having a BN determined according to standard ASTM D-2896 ranging from 150 to 350 milligrams of potassium hydroxide per gram of amine.

In one embodiment of the invention, this use makes it possible to reduce the formation of deposits in the hot parts of a two-stroke marine engine.

All the characteristics and preferences presented for the fatty amine of formula (I) and for the lubricant composition apply to the above use.

The various subjects of the present invention and the implementations thereof will be understood more clearly on reading the examples that follow. These examples are given as a guide, with no limiting nature.

Example 1: Evaluation of the Heat-Resistance Properties of Fatty Amines According to the Invention The heat resistance of fatty amines according to the invention is evaluated by taking temperature measurements via thermogravimetric analysis (TGA).

To do this, each sample of fatty amine is heated over a temperature range ranging from 30° C. to 800° C. while adhering to the following steps:

1) Maintenance of the sample for 2 minutes at a temperature of 30° C.,

2) Raising the temperature of the sample from 30° C. to 800° C. at a gradient of 10° C./min, 3) Cooling the sample from 800° C. to 30° C. at a gradient of 40° C./min, 4) Maintaining the sample for 15 minutes at a temperature of 30° C.

Next, the curve representing the change in loss of mass of the sample as a function of the temperature was determined for each sample.

The temperature corresponding to the point of inflexion of the curve was then determined; the higher the temperature value, the better the heat resistance of the fatty amine.

Six different fatty amines having the following characteristics were evaluated:

fatty amine 1: fatty amine of formula (I) in which $R_1$ and $R_2$ are identical and represent a saturated alkyl group comprising from 16 to 18 carbon atoms and n represents 2 (degree of unsaturation=0; BN=316 mg KOH/g of amine), fatty amine 2: fatty amine of formula R—$[NH(CH_2)_3]_3$—$NH_2$ in which R represents an unsaturated alkyl group comprising from 16 to 18 carbon atoms (degree of unsaturation=50%; BN=477 mg KOH/g of amine), fatty amine 3: fatty amine of formula (I) in which $R_1$ and $R_2$ are identical and represent a saturated alkyl group comprising from 16 to 18 carbon atoms and n represents 1 (degree of unsaturation=0; BN=251 mg KOH/g of amine), fatty amine 4: fatty amine of formula R—$[NH(CH_2)_3]_2$—$NH_2$ in which R represents an unsaturated alkyl group comprising from 16 to 18 carbon atoms (degree of unsaturation=50%; BN=413 mg KOH/g of amine), fatty amine 5: fatty amine of formula (I) in which $R_1$ and $R_2$ are identical and represent a saturated alkyl group comprising from 16 to 18 carbon atoms and n represents 0 (degree of unsaturation=0; BN=197 mg KOH/g of amine), fatty amine 6: fatty amine of formula $(R)_2$—$N(CH_2)_3$—$NH_2$ in which R represents an unsaturated alkyl group comprising from 16 to 18 carbon atoms (degree of unsaturation=40%; BN=334 mg KOH/g of amine).

The results of the six fatty amines tested are collated in table I below.

TABLE I

| | Temperature corresponding to the point of inflexion (° C.) |
|---|---|
| Fatty amine 1 (invention) | 343 |
| Fatty amine 2 (comparative) | 300 |
| Fatty amine 3 (invention) | 338 |
| Fatty amine 4 (comparative) | 299 |
| Fatty amine 5 (invention) | 326 |
| Fatty amine 6 (comparative) | 267 |

The results show that the fatty amines of formula (I) comprising a totally saturated alkyl group (fatty amines 1, 3 and 5) have better heat resistance than fatty amines comprising an unsaturated alkyl group (fatty amines 2, 4 and 6).

Example 2: Evaluation of the Heat Resistance Properties of Lubricant Compositions According to the Invention The resistance of lubricant compositions according to the invention is evaluated by taking temperature measurements by Differential Scanning calorimetry (DSC).

To do this, various lubricant compositions were prepared from the following compounds:

lubricant base oil 1: mineral oils of group I or Brightstock with a mass per unit volume of between 895 and 915 $kg/m^3$, lubricant base oil 2: mineral oils of group I, in particular known as Neutral 600 NS, with a viscosity at 40° C. of 120 cSt measured according to standard ASTM D7279, detergent packet comprising a neutral phenate of BN equal to 145 mg KOH/g of phenate, an overbased phenate of BN equal to 255 mg KOH/g of overbased phenate, an overbased sulfonate of BN equal to 430 mg KOH/g of overbased sulfonate, a dispersant of PIB succinimide type, a fatty alcohol which is a mixture of monoalcohols bearing a hydrocarbon-based chain comprising from 16 to 18 carbon atoms and antifoams, fatty amines 5 and 6 are as described in example 1.

The lubricant compositions $C_1$ and $C_2$ are described in table II; the percentages indicated correspond to mass percentages.

TABLE II

| Compositions | $C_1$ (invention) | $C_2$ (comparative) |
|---|---|---|
| Base oil 1 | 52.5 | 55.5 |
| Base oil 2 | 30.0 | 30.0 |
| Detergent packet | 10.0 | 10.0 |
| Fatty amine 5 | 7.5 | |
| Fatty amine 6 | | 4.5 |
| Total BN (mg KOH/g of composition) | 25 | 25 |

The DSC measurement consists in determining the variation of the heat flow emitted or received by a sample when it is subjected to a temperature program, under a controlled atmosphere.

The operating conditions applied were as follows:

temperature ramp: 10° C./min, aluminum crucible, oxygen flow rate: 50 mL/min.

The oxidation temperature value measured by DSC is given as being the Onset temperature, indicating the start of exothermic oxidation; the higher this value, the better the heat resistance of the sample.

The results are collated in table III below.

TABLE III

| Compositions | $C_1$ (invention) | $C_2$ (comparative) |
|---|---|---|
| Onset temperature (° C.) | 300 | 289 |

The results confirm those presented in example 1; in point of fact, the specific choice of a fatty amine of formula (I) comprising a totally saturated alkyl group (composition $C_1$) makes it possible to significantly increase the oxidation onset temperature, and thus makes it possible to improve the heat resistance of the lubricant compositions relative to fatty amines comprising an unsaturated alkyl group (composition $C_2$)

Example 3: Evaluation of the Heat Resistance Properties of Lubricant Compositions According to the Invention The heat resistance of lubricant compositions according to the invention is evaluated by performing the ECBT test on aged oil.

To do this, various lubricant compositions were prepared from the lubricant base oil 1, the lubricant base oil 2, the detergent packet and the fatty amines 1, 2, 3 and 4 as described in examples 1 and 2.

The lubricant compositions $C_3$, $C_4$, $C_5$ and $C_6$ are described in table IV; the percentages indicated correspond to mass percentages.

TABLE IV

| Compositions | $C_3$ (invention) | $C_4$ (comparative) | $C_5$ (invention) | $C_6$ (comparative) |
|---|---|---|---|---|
| Base oil 1 | 48.5 | 49.5 | 48.1 | 49.1 |
| Base oil 2 | 24.6 | 25.0 | 23.5 | 25.0 |
| Detergent packet | 22.1 | 22.1 | 22.1 | 22.1 |
| Fatty amine 1 | 4.8 | | | |
| Fatty amine 2 | | 3.4 | | |
| Fatty amine 3 | | | 6.3 | |
| Fatty amine 4 | | | | 3.8 |
| Total BN (mg KOH/g of composition) | 74 | 74 | 74 | 74 |

The heat resistance of the lubricant compositions $C_3$, $C_4$, $C_5$ and $C_6$ was thus evaluated by means of the ECBT test on aged oil, via which the mass of deposits (in mg) generated under given conditions is determined. The lower this mass, the better the heat resistance and thus the better the cleanliness of the engine.

This test simulates the behavior of the lubricant composition when it is injected onto the hot parts of the engine and especially onto the top of the piston, and comprises three distinct phases.

The first phase was performed at a temperature of 310° C.

It uses aluminum beakers which simulate the form of pistons. These beakers were placed in a glass container, the lubricant composition being maintained at a controlled temperature of about 60° C. The lubricant was placed in these containers, which were themselves equipped with a metal brush partially immersed in the lubricant. This brush is driven in a rotary motion at a speed of 1000 rpm, which creates a projection of lubricant onto the inner surface of the beaker. The beaker was maintained at a temperature of 310° C. by means of a heating electrical resistance, regulated by a thermocouple. This first phase lasted 12 hours and the projection of lubricant was continued throughout the test.

The second phase consisted of a neutralization of 50 points of BN of each lubricant composition with 95% sulfuric acid, so as to simulate the phenomenon of neutralization of the composition to be similar to the real conditions of use of the lubricant composition in a marine engine.

The final phase is identical to the first phase, except that this phase was performed at a temperature of 270° C.

This procedure makes it possible to simulate the formation of deposits in the piston-ring assembly. The result is the weight of deposits measured in mg on the beaker.

The results are collated in table V below.

TABLE V

| Compositions | $C_3$ (invention) | $C_4$ (comparative) | $C_5$ (invention) | $C_6$ (comparative) |
|---|---|---|---|---|
| ECBT on aged oil (mg) | 73 | 127 | 113 | 147 |

The results show that the specific choice of a fatty amine of formula (I) comprising a totally saturated alkyl group (compositions $C_3$ and $C_5$) makes it possible to significantly reduce the formation of deposits at high temperature, and thus makes it possible to improve the heat resistance of the lubricant compositions relative to amines comprising an unsaturated alkyl group (compositions $C_4$ and $C_6$).

Example 4: Evaluation of the Rheological Properties of Lubricant Compositions According to the Invention The rheological behavior of lubricant compositions according to the invention is evaluated, by measuring the rheology at low shear rates.

The rheology measurements are performed after neutralization of the various lubricant compositions up to 10 points of residual BN using a cylinder (Anton-Paar MCR 301 rheometer; cylinder: $r_i$=13.3 mm $r_e$=14.4 mm and angle=120) at a temperature of 40° C. and at a shear rate of $10^{-2}$ $s^{-1}$.

The values obtained (expressed in Pa·s) correspond to the viscosity of the lubricant composition under shear; the lower this value, the lower the increase in viscosity and thus the better the rheological behavior.

These measurements were taken on the lubricant compositions $C_3$ and $C_5$ as described in example 3, to which were added the following compositions:

a reference cylinder lubricant known as having very good rheological behavior;

This cylinder lubricant is obtained from a mineral lubricant base oil obtained by mixing a distillate with a mass per unit volume at 15° C. of between 880 and 900 kg/$m^3$ with a distillation residue with a mass per unit volume of between 895 and 915 kg/$m^3$ (Brightstock) in a distillate/residue ratio of 3.

To this lubricant base oil is added a concentrate containing an overbased calcium sulfonate of BN equal to 430 mg KOH/g, a dispersant, an overbased calcium phenate of BN equal to 255 mg KOH/g and antifoams.

a $C_7$ lubricant composition and a $C_8$ lubricant composition whose characteristics are described in table VI below (the percentages indicated correspond to mass percentages)

TABLE VI

| Compositions | $C_7$ (invention) | $C_8$ (comparative) |
|---|---|---|
| Base oil 1 | 47.6 | 48.5 |
| Base oil 2 | 22.0 | 26.0 |

TABLE VI-continued

| Compositions | $C_7$ (invention) | $C_8$ (comparative) |
|---|---|---|
| Detergent packet | 22.1 | 22.1 |
| Fatty amine 5 | 8.3 | |
| Fatty amine 7 | | 3.4 |
| Total BN (mg KOH/g of composition) | 74 | 74 |

Fatty amine 5 is as described in example 1.

Fatty amine 7 is a fatty amine of formula R—[NH$(CH_2)_3]_3$—$NH_2$ in which R represents an unsaturated alkyl group comprising from 16 to 20 carbon atoms (degree of unsaturation of 70%; BN=471 mg KOH/g of amine).

The rheological measurements are described in table VII below.

TABLE VII

| Compositions | $C_3$ (invention) | $C_5$ (invention) | $C_7$ (invention) | $C_8$ (comparative) | Reference cylinder lubricant |
|---|---|---|---|---|---|
| Residual viscosity at a shear of $10^{-2}$ $s^{-1}$ (in Pa · s) | 0.4 | 0.5 | 0.4 | 2.0 | 0.2 |

The results show that the specific choice of a fatty amine of formula (I) comprising a totally saturated alkyl group (compositions $C_3$, $C_5$ and $C_7$) makes it possible to minimize the viscosity increase, especially at low shear rates, and thus makes it possible to improve the rheological behavior of the lubricant compositions relative to fatty amines comprising an unsaturated alkyl group (composition $C_8$).

It should be noted that the rheological behavior of the lubricant compositions according to the invention is equivalent to that of the reference cylinder lubricant.

The invention claimed is:

1. A lubricant composition for marine engines, comprising:

at least 40% by weight of lubricant base oil, at least one fatty amine of formula (I):

$$R_1R_2N—(CH_2)_3—[NH(CH_2)_3]_n—NH_2 \quad (I)$$

wherein:

$R_1$ represents a saturated, linear or branched alkyl group comprising at least 14 carbon atoms, $R_2$ represents a saturated, linear or branched alkyl group comprising at least 14 carbon atoms, n represents 0, 1 or 2, the fatty amine having a BN determined according to standard ASTM D-2896 ranging from 150 to 350 milligrams of potassium hydroxide per gram of amine, and at least 3% by weight of overbased detergent and/or neutral detergent relative to a total weight of the composition, the overbased and/or neutral detergent selected so that a BN provided by the overbased and/or neutral detergent represents a contribution of greater than 40 mg KOH/g of lubricant, wherein a mass percentage of fatty amine of formula (I) relative to the total weight of the lubricant composition is from 0.1 to 15% and is chosen so that a BN provided by the fatty amine of formula (I) represents a contribution of from 5 to 30 milligrams of potassium hydroxide per gram of lubricant, and said lubricant composition having a BN determined according to standard ASTM D-2896 of at least 74 milligrams of potassium hydroxide per gram of lubricant composition and a kinematic viscosity measured according to standard ASTM D445 at 100° C. ranging from 12.5 to 26.1 cSt.

2. The lubricant composition as claimed in claim 1, wherein the BN of the fatty amine determined according to standard ASTM D-2896 ranges from 170 to 340 milligrams of potassium hydroxide per gram of amine.

3. The lubricant composition as claimed in claim 2, wherein the BN of the fatty amine determined according to standard ASTM D-2896 ranges from 180 to 320 milligrams of potassium hydroxide per gram of amine.

4. The lubricant composition as claimed in claim 1, having a BN determined according to standard ASTM D-2896 of at least 80 milligrams of potassium hydroxide per gram of lubricant composition.

5. The lubricant composition as claimed in claim 1, having a BN determined according to standard ASTM D-2896 ranging from 74 to 120 milligrams of potassium hydroxide per gram of lubricant composition.

6. The lubricant composition as claimed in claim 5, having a BN determined according to standard ASTM D-2896 ranging from 74 to 100 milligrams of potassium hydroxide per gram of lubricant composition.

7. The lubricant composition as claimed in claim 1, wherein the mass percentage of fatty amine relative to the total weight of lubricant composition ranges from 2 to 10%.

8. A method for reducing the formation of deposits in the hot parts of a marine engine, said method comprising at least one step of placing the marine engine in contact with a lubricant composition according to claim 1.

9. A method as claimed in claim 8, wherein the lubricant composition is a one-cylinder lubricant and may be used both with fuel oils with a sulfur content of less than 1% by weight relative to the total weight of the fuel oil and with fuel oils with a sulfur content ranging from 1 to 3.5% by weight relative to the total weight of the fuel oil.

10. A method as claimed in claim 8, wherein the lubricant composition is a cylinder lubricant and may be used with fuel oils with a sulfur content of less than 0.5% by weight relative to the total weight of the fuel oil.

11. The lubricant composition as claimed in claim 1, wherein:

$R_1$ represents a saturated, linear or branched alkyl group comprising from 14 to 22 carbon atoms, $R_2$ represents a saturated, linear or branched alkyl group comprising from 14 to 22 carbon atoms.

12. The lubricant composition as claimed in claim 1, wherein $R_1$ and $R_2$, which are identical, represent a saturated, linear or branched alkyl group comprising from 14 to 22 carbon atoms.

13. The lubricant composition as claimed in claim 1, wherein the fatty amine is chosen from:

a fatty amine of formula (Ia):

$$(R_1)_2N—(CH_2)_3—NH_2 \quad (Ia)$$

wherein $R_1$ represents a saturated, linear or branched alkyl group comprising from 14 to 18 carbon atoms; or a fatty amine of formula (Ib-1):

$$(R_1)_2N—(CH_2)_3—NH(CH_2)_3—NH_2 \quad (Ib\text{-}1)$$

wherein $R_1$ represents a saturated, linear or branched alkyl group comprising from 14 to 18 carbon atoms; or a fatty amine of formula (Ib-2):

$$(R_1)_2N—(CH_2)_3—[NH(CH_2)_3]_2—NH_2 \quad \text{(Ib-2)}$$

wherein $R_1$ represents a saturated, linear or branched alkyl group comprising from 14 to 18 carbon atoms.

* * * * *